US005541611A

United States Patent [19]

Peng et al.

[11] Patent Number: 5,541,611

[45] Date of Patent: Jul. 30, 1996

[54] VHF/UHF TELEVISION ANTENNA

[76] Inventors: Sheng Y. Peng, 731 Insparation La., Escondido, Calif. 92025; Wong Foy, 7844 Mission Bonita Dr., San Diego, Calif. 92120

[21] Appl. No.: 435,847

[22] Filed: May 5, 1995

Related U.S. Application Data

[63] Continuation of Ser. No. 213,516, Mar. 16, 1994, abandoned.

[51] Int. Cl.[6] ..... H01Q 1/38; H01Q 13/08

[52] U.S. Cl. ..... 343/767; 343/786

[58] Field of Search ..... 343/767, 770, 343/795, 786; H01Q 1/38, 13/00, 13/02, 13/04, 13/08

[56] References Cited

U.S. PATENT DOCUMENTS

| | | | |
|---|---|---|---|
| 3,577,196 | 5/1971 | Pereda | 343/770 |
| 4,038,662 | 7/1977 | Turner | 343/802 |
| 4,843,403 | 6/1989 | Lalezari et al. | 343/767 |
| 4,853,704 | 8/1989 | Diaz et al. | 343/770 |
| 5,036,335 | 7/1991 | Jairam | 343/767 |
| 5,081,466 | 1/1992 | Bitter | 343/767 |
| 5,142,255 | 8/1992 | Chang et al. | 343/767 |
| 5,268,701 | 12/1993 | Smith | 343/767 |

*Primary Examiner*—Michael C. Wimer

*Attorney, Agent, or Firm*—Gilliam, Duncan & Harms

[57] ABSTRACT

A flat planar antenna formed from a flat this substrate coated on one surface with a electrically conductive material except for a first uncoated funnel shaped cavity with a large mouth beginning along one outer surface of the substrate and diminishing in cross-section toward the center of the substrate with a diminishing width down to an extended neck portion which extends to an outer substrate surface normal or parallel to the substrate surface adjacent to the mouth. A smaller tuning cavity may be positioned over the neck portion adjacent to the edge of the substrate. The antenna may have feed lines plated on the opposite surface from the funnel shaped cavity, hard wired through the substrate to the opposite side thereof or formed by micro stripline techniques. A second embodiment employs unplated side cavities between the funnel unplated area and the edges of the substrate normal to the funnel mouth.

11 Claims, 2 Drawing Sheets

VHF/UHF TELEVISION ANTENNA

This is a continuation of application Ser. No. 08/213,516 filed on Mar. 16, 1994 now abandoned.

FIELD OF INVENTION

The invention is directed generally to antennas for radio wave communication and particularly to television VHF/UHF receiving and transmitting antennas.

BACKGROUND OF THE INVENTION

Since the early days of television and extending to the present day it has generally believed that large external antennas or cable hookup is necessary to provide a television receiver with the required signal strength to provide a perfect picture and sound to the viewer.

External antennas generally take the form of large cumbersome conic or Yagi type construction and are placed outdoors either on a pole on the roof top of the building housing the receiver or in attic or the like of a building. These antennas are somewhat fragile as they are formed by the combination of a plurality of parts including reflectors and receiving elements formed of light weight aluminum tubing or the like having various lengths to satisfy the frequency requirements of the received signals and plastic insulators. The receiving elements are held in relative position by means of the insulators and the reflectors elements are grounded together.

Assemblage of these antennas is required either by the user which may bend or break some of the elements during construction which must be replaced or become injured by falling or the like or by an installer for hire either of which increase the already high economic cost of the antenna.

Externally placed antennas of this type are continually subjected to the elements. Even if not damaged or destroyed by the elements during harsh weather conditions over time these antennas will generally produce poor reception or reduced reception during extreme weather conditions or will gradually reduce their ability to produce acceptable reception over time due to mechanical decay.

In addition to the above deficiencies, this type of receiving antenna is aesthetically ugly.

Other antennas that are currently used are indoors antennas which are easy on the eyes but unacceptable for producing a good picture and sound. The most common and effective of these indoor antennas is the well known dual dipole type positioned adjacent to or on the television receiver and affectionately referred to as "rabbit ears". These antennas are generally ineffective for fringe area reception and are only effective for strong local signal reception. When low frequency signals reception is desired, the dipoles must be extended to their maximum length which makes the "rabbit ear" antenna susceptible to tipping over or interfering with or causing possible damage to any adjacent objects.

Cable systems are also currently used for delivering signals to television receivers. This system is highly successful for delivering picture perfect signals to a television receiver over a large range of frequencies. One of the strongest disadvantages to the cable signal delivery systems is the economic cost of installation and the periodic cost of the signal delivery to the user which can run as high as one hundred dollars monthly.

Satellite dishes with their accompanying accessories is another of the present methods of receiving television signals. This method is popular and successful for receiving signals from fixed in position satellites. Systems of this type require large diameter dishes generally in excess of six feet and ideally about twelve feet for receiving acceptable signal levels. Small dishes under two feet in diameter are presently unusable for all but the most powerful satellite transmitters. The acceptable sized dishes are ugly to view and because of size are hard to hide from sight. In addition the systems as they exist today are quite expensive and, therefore, not available to all who desire to view picture perfect television reception.

There has not been a highly signal sensitive, visually attractive indoor television antenna until the emergence of the instant antenna.

SUMMARY OF THE INVENTION

The instant invention employs a completely new concept in indoor antennas. The antenna of the instant invention is based upon a planar antenna formed by printed-circuit technology. The antenna is a two-dimensional horn or notch antenna type. The antenna is formed on a substrate of such materials as MYLAR, fiberglass, REXLITE, polystyrene, polyimide, TEFLON, fiberglass or any other such material suitable for the purpose intended. The substrate may be flexible whereby the antenna can be rolled up for storage and unrolled into a planar form for use or rigid forming a flat rigid planar configuration. The antenna element formed on the substrate can be any suitable conductive material, as for example, aluminum, copper, silver, gold, platinum or any other electrical conductive material suitable for the purpose intended. The conductive material is adhered to the substrate by any known technology.

In a preferred embodiment, the antenna conductive material coating on a first side of the substrate is formed with a non-plated first cavity in the form of a horn having the general appearance of a cross-section of a "horn of plenty" beginning with a large uncoated or unplated surface area (the mouth) at one edge of the substrate with the unplated area gradually reducing in cross-sectional area to a narrow throat region which extends in a direction substantially normal to the mouth of the horn. The throat region extends into a second smaller unplated cavity which is configured for a predetermined frequency. On the opposite surface of the substrate, a pair of spaced apart feedlines extend from the area of the throat intermediate the first and second cavities pass through the substrate and are electrically connected with one of the feedlines connected on each side of the throat region.

The location of the feedlines, the size of the cavities and the shape of the horn may be of the antenna designers choice for best results for a given use and frequency.

In a second embodiment of the invention the energy is fed into or received from the antenna via a microstrip feedline printed on the opposite surface of the substrate from the horn.

The first cavity may take many different physical shapes such as, rectangular, square, circle or any other suitable form to achieve the intent of this invention. The curved portion of the throat region can also take other shapes as for example, semi-circular, meandering or the like.

As the antenna of this invention is extremely thin in cross-section, it can be integrated with a wall hanging, such as a tapestry, painting, picture of the like, a flat television set, may be placed on a car or train window or roof, or any other suitable application for which antennas are intended.

When the antenna is formed on a flexible substrate, it can be rolled for storage or transport without damage to the antenna and can be stored in a small space.

Accessories such as signal amplifiers, dividers, etc. can be used with the antenna to enhance its performance or for connection to multiple receivers.

The principle object of this invention is to produce an improved indoor antenna for signal receiving or transmission.

Another object of the president invention is to provide an indoor antenna which is extremely thin in cross-section relative to its physical length and height.

Yet another object of this invention is to provide an indoor antenna which is constructed on a substrate by known printing or plating methods.

Still another object of the invention is to produce an antenna that can be rolled for storage or transport.

Still another object of this invention is to produce an antenna which is aesthetically pleasing.

The subject matter which is regarded as this invention is particularly pointed out and distinctly claimed in the concluding portion of the specifications. The invention, however, as to its organization and operation, together with further objects and advantages thereof, will best be understood by reference to the accompanying drawings in which:

BRIEF DESCRIPTION OF THE DRAWING FIGURES

DETAILED DESCRIPTION OF THE PREFERRED EMBODIMENT

Figure 1A:
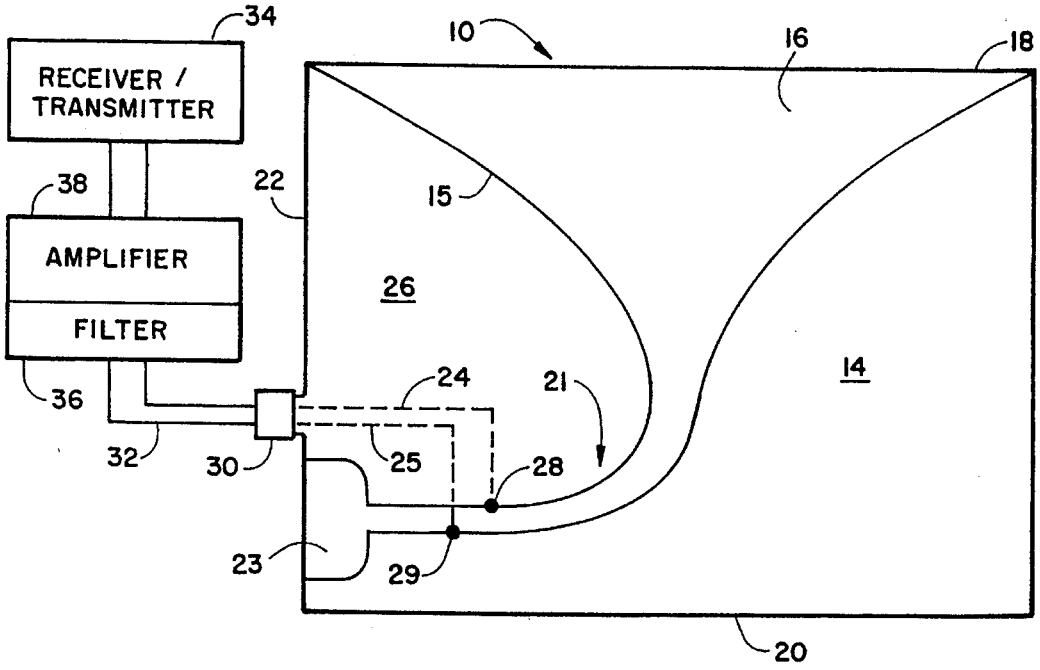
FIG. 1A depicts a schematic showing of one side of the preferred embodiment of the invention.

Referring now specifically to the drawing FIG. 1A, the antenna 10 of the invention is attached to a substrate 26 which may be constructed of either a rigid or flexible material such as, MYLAR, fiberglass, REXLITE, polystyrene, polyimide, TEFLON fiberglass, or any other such material which would be suitable for the purpose intended. One surface 14 is coated with a conductive material by circuit board, microstripline or the like construction well known in this art. Any means for affixing the conductive material to the substrate is acceptable to practice this invention. The conductive material as for example, include but are not limited to aluminum, copper, silver, gold, platinum or any other electrical conductive material which is suitable for the purpose intended.

As shown in FIG. 1A the surface conductive material on first surface 14 is etched away, removed by suitable means or left uncoated in the coating process to form a first horn 15 with a mouth or enlarged area 16 at edge 18 and the uncoated surface area reduces in cross-section as the uncoated surface extends in a curvalinear fashion toward edge 20. The narrow end of the horn curves first in a direction normal to edge 18 then parallel to edge 18 and terminates at edge 22 forming a throat 21.

Within the first horn 15 and at the end of the throat of the antenna is a second smaller cavity 23 for tuning the horn 15 to enlarge the frequency range of the antenna and feed lines 24, 25, herein after discussed in detail. The second smaller cavity 23 has a predetermined configuration for tuning the first cavity at a predetermined frequency.

Figure 1B:
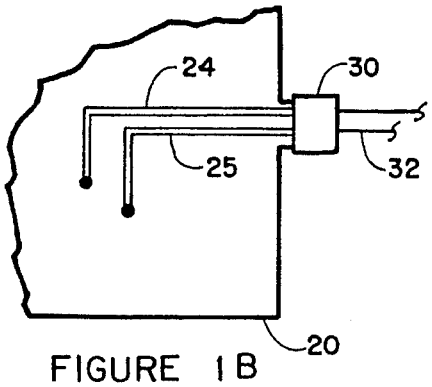
FIG. 1B depicts a schematic showing of the second side of the antenna of the invention which is on the back of the first side depicted in FIG. 1A.

On the second side of the substrate which is opposite the first side of the substrate 26, which is depicted in drawing FIG. 1B, includes a pair of conductors 24, 25 which are either individual wires or separate strip conductors which are coated on the substrate at the same time that the first side is coated and by the same process and conductive material. These connectors 24, 25 are connected to the outer edges of the throat of the horn at locations 28 and 29 respectively by passing separate wires through the substrate and electrically connecting at those locations. The conductors 24, 25 extend to the edge 22 of the substrate and are connected to a suitable connector 30 which is connected to a cable or the like to a signal line 32 that connects to a receiver or transmitter 34 to which the antenna is associated.

Between the receiver or transmitter 34 and the connector 30, accessories, such as filters 36, amplifiers 38, etc may be placed in series therewith.

Figure 2A:
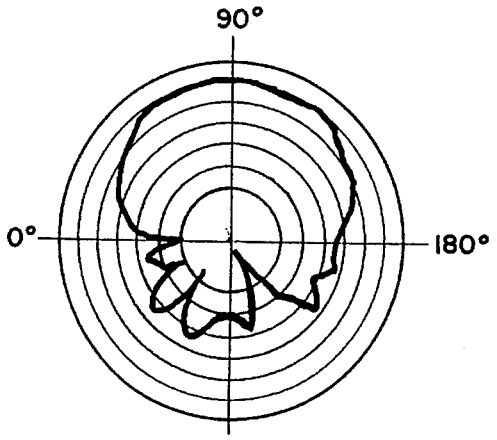
FIG. 2A depicts the azimuth pattern of the antenna of the invention.
Figure 2B:
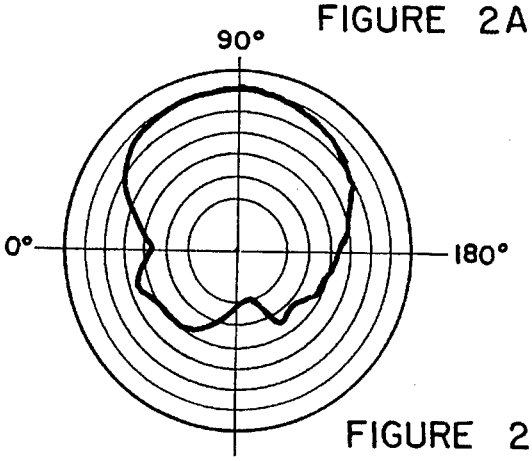
FIG. 2B depicts the elevation pattern of the antenna of the invention.

FIGS. 2A and 2B respectfully depict the Azimuth and Elevation radiation pattern of the antenna of drawing FIG. 1.

Figure 3:
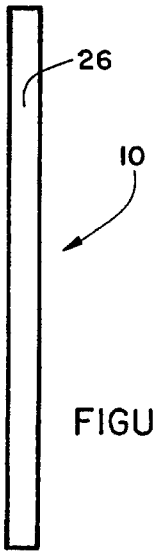
FIG. 3 is a end view showing of antenna of FIGS. 1A and 1B.

Drawing FIG. 3 depicts the overall thickness of the substrate antenna 10 including substrate 26 which ranges in thickness nominally from 2 to 250 mils and the conductive coating which ranges in thickness nominally from 0.5 to 1 (mils) with the overall thickness of the antenna from 2.5 to 251 (mils).

Figure 4:
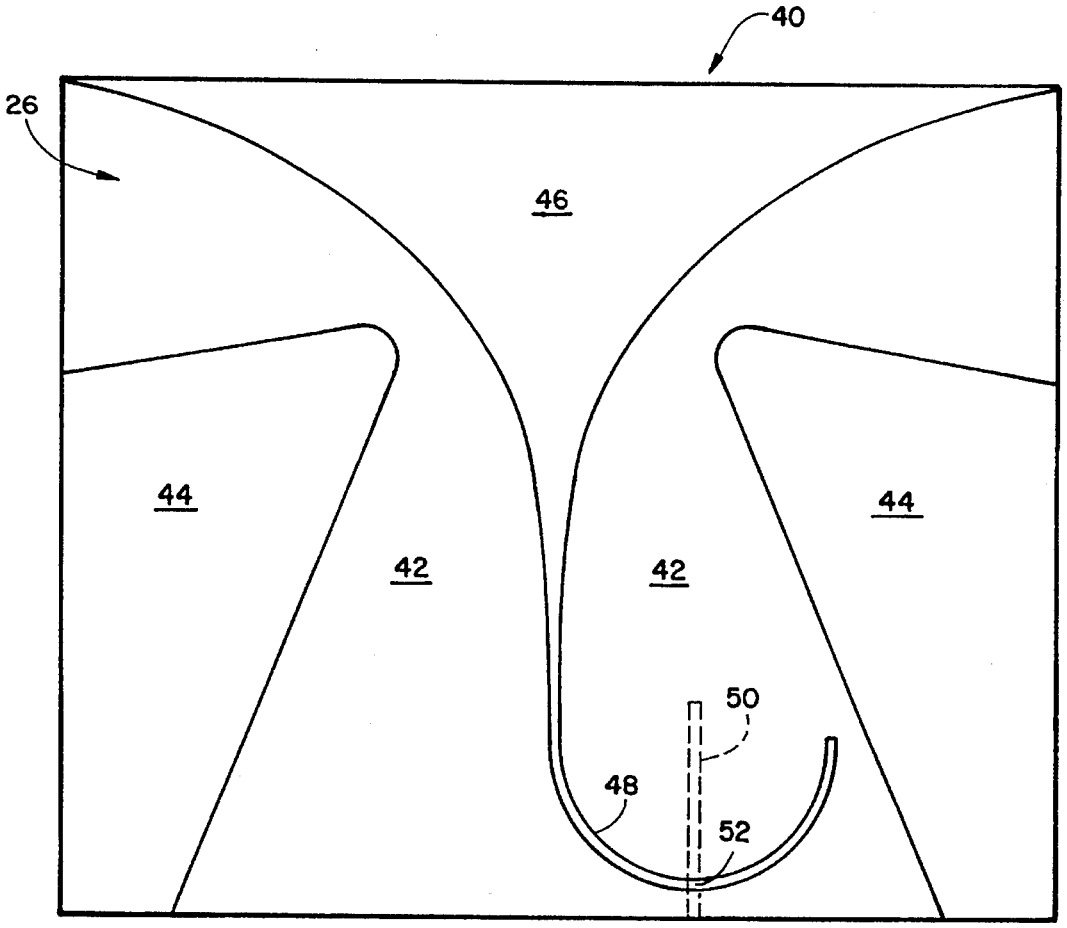
FIG. 4 depicts a schematic showing of a second embodiment of the antenna of the invention.

FIG. 4 depicts a second embodiment 40 of the planar VHF/UHF antenna the invention. In this embodiment the surface 42 of one side of the substrate 26 ( the side facing the viewer of drawing FIG. 4) is coated as in the Preferred Embodiment of FIG. 1A with areas 44 and the horn 46 including narrow portion of the horn 48 are left as uncoated substrate. As shown in FIG. 4, the narrow the narrow portion of the horn extends in a curvilinear direction through a semi-circle beginning and extending along a plane substantially normal to the mouth of the cavity, extending along a plane substantially parallel to the mouth of cavity and ending along a plane substantially normal to the mouth of the cavity. On the opposite surface (behind the surface presented to the viewer), shown in phantom, is a microstrip feedline 50 well known in this art for receiving signal or delivering signal to the antenna 40. The microstrip feed line is on a plane normal to the area of the narrow portion of the horn is substantially parallel with the mouth of the horn.

There may be other planar printed-circuit antenna configurations by modifying the feedline methods, the curved throat regions the conductive surfaces adjacent to the horn region or any combination of the above mentioned parameters.

While described above are the principles of the embodiment of the flat planar antenna of the invention in connection with a specific design and materials of construction it is to be clearly understood that this description is made only by way of example and not as a limitation to the scope of the invention as set forth in the summary thereof and in the accompanying claims.

What is claimed is:

1. A flat planar antenna comprising:

a substrate having a thickness in the range of 2 to 250 mils;

a first substrate surface a portion of which is covered with a conductive material and a portion of which is uncovered;

a first cavity formed by said uncovered portion, said first cavity having a large mouth area beginning at a first edge of said substrate and reducing in cross-section as said uncovered portion extends from said first edge thereby forming a narrow curvalinear necked down area extending firstly in a direction normal to said first edge and then in a direction parallel to said first edge toward a second edge of said substrate, said second edge being normal to said first edge;

a second cavity formed as an extension of said necked down area having a cross-sectional area greater than said necked down area and extending from the distal end of said necked down area to said second edge for tuning said antenna to a predetermined frequency;

a pair of conductors positioned on a second surface of said substrate opposite to said necked down area of said first cavity, a first end of one of said pair of connectors is electrically connected to the conductive material positioned adjacent to one side of said necked down area and the first end of the other one of said pair of connectors is connected to the conductive material adjacent to the opposite side of said necked down area; and a connector connected to the second ends of said conductors for connecting a receiver or a transmitter to said antenna, said antenna being formed only on said first substrate surface.

2. The antenna as defined in claim 1 wherein said pair of conductors are coated on said substrate.

3. The antenna as defined in claim 1 wherein said conductors are single wires.

4. The antenna as defined in claim 1 wherein said conductors are of micro-stripline construction.

5. The antenna as defined in claim 1 wherein said antenna is stripline constructed.

6. The antenna as defined in claim 1 wherein said antenna is flexible and can be rolled for storage or transport.

7. The antenna as defined in claim 1 wherein said antenna is rigid.

8. The antenna as defined in claim 1 wherein said antenna and said conductors are of micro-stripline construction.

9. The antenna as defined in claim 1 wherein said conductive material being of a thickness in the range of 0.5 to 1 mil.

10. A flat planar antenna comprising:

a substrate having a thickness in the range of 2 to 250 mils;

a first substrate surface a portion of which is covered with a conductive material and first, second and third spaced apart uncovered portions;

a cavity formed by said first uncovered portion, said cavity having a large mouth area beginning at a first edge of said substrate and reducing in cross-section as said first uncovered portion extends from said first edge thereby forming a narrow curvalinear necked down area extending firstly in a direction normal to said first edge and then in a substantially semi-circular direction back toward said first edge of said substrate;

said second uncovered substrate portions being located adjacent to said covered portion with one positioned on each side thereof spaced from said first uncovered portion;

a pair of conductors positioned on a second surface of said substrate opposite to said necked down area of said cavity, a first end of one of said pair of connectors is electrically connected to the conductive material adjacent to one side of said necked down area and the first end of the other one of said pair of connectors is connected to the conductive material adjacent to the opposite side of said necked down area; and a connector connected to the second ends of said conductors for connecting a receiver or a transmitter to said antenna, said antenna being formed only on said first substrate surface.

11. A flat planar antenna comprising:

a planar substrate having a thickness in the range of 2 to 250 mils;

a first substrate surface a portion of which is covered with a conductive material and a portion of which is uncovered;

a first cavity formed by said uncovered portion, said first cavity having a large mouth area beginning at a first edge of said substrate, extending from said edge in a progressively reduced cross-section to a necked down area, said necked down area extending in a curvilinear direction through substantially a semi-circle, said necked down area beginning in a direction along a plane substantially normal to said first edge, thence at one location therealong being on a plane substantially parallel to the mouth of cavity and ending along a plane substantially normal to the mouth of the cavity;

a microstrip feedline positioned on a second surface of said substrate opposite to said necked down area of said first cavity, said microstrip feedline being on a plane that intersects said necked down area at said one location along the length of said necked down area and is substantially normal thereto for delivering signals and receiving signals from said antenna; and means connected to said microstrip feedline for connecting a receiver or a transmitter to said antenna.

* * * * *